US009388679B2

(12) United States Patent
Morrison

(10) Patent No.: US 9,388,679 B2
(45) Date of Patent: Jul. 12, 2016

(54) DOWNHOLE GAS AND LIQUID SEPARATION

(71) Applicant: Legacy Separators LLC, Gillette, WY (US)

(72) Inventor: Guy Morrison, Gillette, WY (US)

(73) Assignee: Legacy Separators, LLC, Gillette, WY (US)

( * ) Notice: Subject to any disclaimer, the term of this patent is extended or adjusted under 35 U.S.C. 154(b) by 368 days.

(21) Appl. No.: 13/844,288

(22) Filed: Mar. 15, 2013

(65) Prior Publication Data

US 2013/0284423 A1 Oct. 31, 2013

Related U.S. Application Data

(63) Continuation-in-part of application No. 12/886,207, filed on Sep. 20, 2010, now Pat. No. 8,424,597, which is a continuation-in-part of application No. 12/612,065, filed on Nov. 4, 2009, now abandoned, which is a continuation-in-part of application No. 12/567,933, filed on Sep. 28, 2009, now abandoned.

(51) Int. Cl.
*E21B 43/38* (2006.01)

(52) U.S. Cl.
CPC ..... *E21B 43/38* (2013.01)

(58) Field of Classification Search
CPC ..... E21B 21/002; E21B 43/38; E21B 21/067; E21B 43/121; E21B 43/128; B01D 45/14; B01D 53/24; B01D 19/0052; B01D 19/0057
See application file for complete search history.

(56) References Cited

U.S. PATENT DOCUMENTS

| | | | | |
|---|---|---|---|---|
| 3,304,006 | A | 2/1967 | Adams | |
| 4,088,459 | A | 5/1978 | Tuzson | |
| 4,231,767 | A | 11/1980 | Acker | |
| 5,673,752 | A | 10/1997 | Scudder et al. | |
| 5,902,378 | A | 5/1999 | Obrejanu | |
| 6,036,749 | A | 3/2000 | Ribeiro et al. | |
| 6,066,193 | A | 5/2000 | Lee | |
| 6,155,345 | A * | 12/2000 | Lee | B01D 19/0052 166/105.5 |
| 6,382,317 | B1 | 5/2002 | Cobb | |
| 6,761,215 | B2 | 7/2004 | Morrison et al. | |
| 7,461,692 | B1 | 12/2008 | Wang | |
| 7,462,225 | B1 | 12/2008 | Ketter et al. | |
| 2004/0045708 | A1 | 3/2004 | Morrison et al. | |

* cited by examiner

*Primary Examiner* — Cathleen Hutchins
(74) *Attorney, Agent, or Firm* — Antionette M. Tease

(57) ABSTRACT

A gas separator connectable to a pump for flowing production fluid, the separator having a housing defining an internal cavity with an inlet end defining for the production fluid. A housing first pumping stage pressurizes the production fluid, and a first fluid flow restrictor downstream of the first pumping stage limits the production fluid to a selected first flow rate. A first separation chamber in the housing downstream of the first fluid flow restrictor separates some gas from the production fluid, and a housing second pumping stage further pressurizes the production. A second fluid flow restrictor downstream of the second pumping stage limits the production fluid flow to a selected second flow rate, and a second separation chamber downstream to the second fluid flow restrictor effects further gas separation from the production fluid.

7 Claims, 8 Drawing Sheets

DOWNHOLE GAS AND LIQUID SEPARATION

RELATED APPLICATIONS

This is a continuation-in-part to U.S. patent application Ser. No. 12/886,207 entitled DOWNHOLE GAS AND LIQUID SEPARATION, filed Sep. 20, 2010, which is a continuation-in-part to U.S. patent application Ser. No. 12/612,065 entitled MULTISECTION DOWNHOLE SEPARATOR AND METHOD, filed Nov. 4, 2009, which is a continuation-in-part application to U.S. patent application Ser. No. 12/567,933 entitled MULTISTAGE DOWNHOLE SEPARATOR AND METHOD, filed Sep. 28, 2009.

BACKGROUND

The present embodiments relate to the separation of gas from liquids in oil and gas wells, and particularly to methods of downhole separation of gas and liquid from a producing reservoir.

Production fluid, the fluid obtained from oil and gas wells, is generally a combination of substantially incompressible liquids and compressible gases. In particular, production fluid for methane production from coal formations includes such gases and water. Conventionally, pumping of such production fluid has presented difficulties due to the compressibility of the gases, which leads in the best of circumstances to reduction in pumping efficiency, and more detrimental, to pump lockage or cavitation.

Cavitation happens as cavities or bubbles form in pumped fluid, occurring at the low pressure or suction side of a pump. The bubbles collapse when passing to higher pressure regions, causing noise and vibration, leading to material erosion of the pump components. This can be expected to cause loss of pumping capacity and reduction in head pressure, reducing pump efficiency to the point of, over time, pump stoppage.

This has lead to the use of downhole gas and liquid separators to remove much of the compressible gasses from the production fluid prior to admission of the liquid component of the production fluid to the pump suction port. Gas separation conventionally is performed on production fluid at the bottom of the tubing string before pumping the liquid up the tubing, thereby improving efficiency and reliability of the pumping process. In some cases, waste components of the production fluid are re-injected above or below the production formation instead of bringing such waste components to the surface.

Examples of previously attempted solutions for downhole gas and liquid separators are taught by U.S. Pat. No. 5,673,752 to Scudder et al. (a separator that uses hydrophobic membrane for separation); U.S. Pat. No. 6,036,749 to Ribeiro et al. (a helical separator); U.S. Pat. No. 6,382,317 to Cobb (a powered rotary separator); U.S. Pat. No. 6,066,193 to Lee (inline separators with differently sized internal diameters); U.S. Pat. No. 6,155,345 to Lee et al. (a separator having flow-through bearings and multiple separation chambers); U.S. Pat. No. 6,761,215 to Morrison et al. (a rotary separator with a restrictor that creates a pressure drop causing gas and liquid separation as the fluid enters the separation chamber); and U.S. Pat. No. 7,461,692 to Wang (multiple separation stages with each separation stage having a rotor with an inducer and impeller).

While many improvements have been taught by the prior art, there remains the need for efficient downhole gas separation that addresses the problems and shortcomings of such art, as the demands of the hostile environment of the downhole conditions of reservoir fluid at advanced pressures and elevated temperature conditions have continually been challenging. There is a need for downhole gas separation that can provide improved production rates while maintaining improved fluid lifting efficiencies over widely variable production conditions. It is to these improvements that the embodiments of the present invention are directed.

SUMMARY OF THE INVENTION

Various embodiments of the present invention are generally directed to the production of gas and liquid from a subterranean formation.

In accordance with some embodiments, a separator is provided for separating gas from a production fluid produced from an oil well extending into a subterranean formation. The separator is connectable to a pump for flowing the production fluid through the separator. The separator has a housing sized to be insertable into the oil well and defining an internal cavity. The housing has an inlet at one end defining a passage for entry of the production fluid into the cavity. A first pumping stage in the housing pressurizes the production fluid from the inlet to flow in a direction substantially parallel to the longitudinal direction of the housing. A first fluid flow restrictor in the housing, downstream of the first pumping stage, defines a passage limiting the production fluid from the first pumping stage to a selected first flow rate. A first separation chamber is in the housing downstream of the first fluid flow restrictor, in which some of the gas separates from the production fluid. A second pumping stage in the housing further pressurizes the production fluid from the first separation chamber. A second fluid flow restrictor in the housing, downstream of the second pumping stage, defines a passage limiting the production fluid flow from the second pumping stage to a selected second flow rate, wherein the second flow rate is less than the first flow rate of the first fluid flow restrictor. A second separation chamber is in the housing downstream of the second fluid flow restrictor, in which more of the gas separates from the liquid in the production fluid.

These and various other features and advantages that characterize the claimed invention will become apparent from the following detailed description, the associated drawings and the appended claims.

BRIEF DESCRIPTION OF THE DRAWINGS

Details of various embodiments of the present invention are described in connection with the accompanying drawings that bear similar reference numerals.

DESCRIPTION

Figure 1:
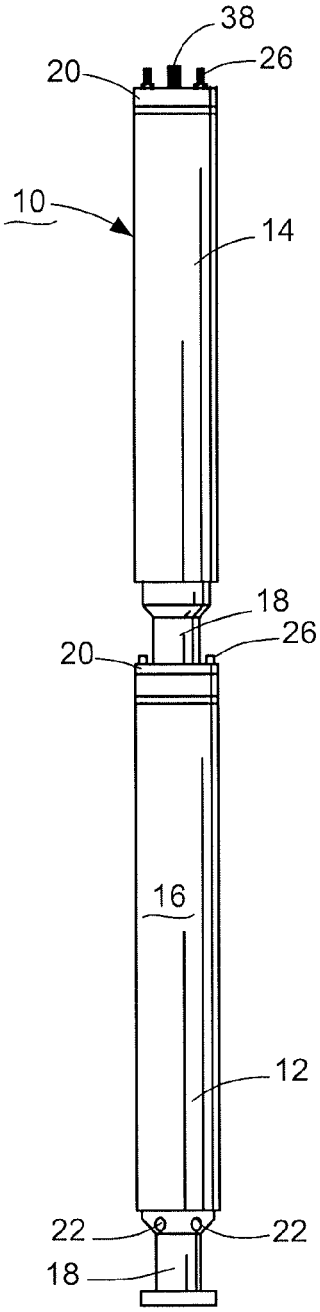
FIG. 1 is a partially detailed, side elevational representation of a downhole gas separator capable of practicing the present invention.

Describing the specific embodiments herein chosen for illustrating the present invention, certain terminology is used that will be recognized as being employed for convenience and having no limiting significance. For example, the terms "top", "bottom", "up" and "down" will refer to the illustrated embodiment in its normal position of use. "Inward" and "outward" refer to radially inward and radially outward, respectively, relative to the longitudinal axis of the illustrated embodiment of the device. "Upstream" and "downstream" refer to normal direction of fluid flow during operation. All such terminology shall also include derivatives thereof.

The present disclosure is generally directed to production fluids from a subterranean formation, such as gas, water (fresh or brine), oil or any other matter that are generally collectively referred to herein as production fluid. As explained below, a method is generally disclosed for separating gas from liquid in a gas and liquid producing oil well having a bore extending from ground surface to a reservoir level and having an oil well tubing extending from the surface. Gas is separated from liquid by a downhole gas separator having a gas and liquid separation chamber, and liquid is pumped from the separation chamber by a variable speed downhole submersible pump to the oil well tubing at a rate to at least partially vacate the separation chamber, thereby providing sufficient space in the separation chamber for the gas to have adequate residence time in the chamber to separate from the liquid. Both the liquid stream, which passes to the tubing, and the separated gas stream, which passes external to the tubing to the well bore, flow as separated streams to the surface.

More particularly, the downhole gas separator receives gas and liquid fluid from the reservoir through the well bore, restricting the amount of gas and liquid entering the separation chamber to a predetermined flow rate that is less than the set pumping rate of the submersible pump. A vortex of the gas and liquid is generated in the separation chamber so liquid is moved to the periphery of the separation chamber and the gas remains near the axial center of the separation chamber; the gas is separated from the liquid to pass through a gas outlet port into the well bore and transported to the surface by the buoyancy, and the separated liquid passes to a liquid inlet port of the submersible pump.

The rate of fluid flow to the separation chamber is selectively determined in relation to the liquid pumping rate of the downhole submersible pump so as to admit less liquid to the separation chamber than the liquid pumping rate of the downhole submersible pump. That is, the capacity of the downhole submersible pump will be considered in sizing the inlet flow rate to the separation chamber, and the pumping rate will be set, so as to cause the submersible pump to run "lean," thereby inducing a drop in pressure in the separation chamber.

This selected sizing of components provides the capability for the submersible pump to continuously "outrun" and empty liquid from the separation chamber, and generally, the submersible pump will run just on the edge of cavitation. This is a new and revolutionary theory of operation that is contrary to conventional systems that seek to maintain the liquid passing into the pump under compression to prevent such cavitation, conventionally considered to be deleterious. The efficacy of the present embodiments has been successfully demonstrated in numerous field installations having performance unmatched by conventional systems.

In accordance with a preferred embodiment, the gas and liquid fluid received by the downhole gas separator is passed through a flow restrictor having one or more calibrated bores, the sum of the cross sectional flow areas of the calibrated bores being a predetermined value that permits passage of the gas and liquid fluid at a predetermined flow rate that is less, by a predetermined amount, than the pumping rate of the submersible pump.

While the various embodiments of the present invention are not limited to a particular separator apparatus, the downhole separation will be described as being conducted by a downhole separator 10 shown in FIG. 1. As will become clear, the downhole separator 10, in its operational application, will be supported from a submersible pump (not shown in FIG. 1) that in turn is supported from the lower end of a tubing string (also not shown) that is positioned in the well bore of an oil well that provides fluid communication with a gas and oil producing geological, underground reservoir so the gas and oil fluid can be pumped to surface located facilities. As used herein, the term oil well shall have its usual meaning of an oil producing well, a gas producing well or a gas and oil producing well.

The downhole separator 10 has a housing 16 that includes both a lower first separator section 12 and an upper second separator section 14. For purposes of these illustrative embodiments, the housing 16 is formed by attaching the separator sections 12, 14 together at a medial portion of the housing 16. The contemplated embodiments are not so limited, however, in that alternative equivalent embodiments the housing 16 can be unitarily constructed to form the separator sections 12, 14. Each of the separator sections 12, 14 defines an interior cavity in which, as described below, is located a flow restricting means, an internal pump and a separation chamber. Except as described herein, the construction of the first and second separator sections 12, 14 is similar, so it will be necessary only to describe the construction details with regard to one of the sections. Of course, it will be appreciated that the quantity of production fluid passing through the lower, first separator section 12 will be reduced by the amount of gas removed therefrom, so that the quantity of fluid passed to the upper, second separator section will be less than that through the first separator section. Thus, the sizing of the internal components will be different for the two separator sections.

The number of separator sections, and the flow capacity of the sections, is predetermined to be less than the pumping capacity of the submersible pump, which in turn is engineered to service the withdrawal capacity of the well. This is also a function of the gas content of the production fluid. The entering flow rate from the reservoir through the separator, being determined to be lower than the submersible pump flow rate, assures vacating the upper separation chamber. The downstream separator sections are designed to handle lower fluid flow rates, because the gas removed from upstream sections diminish the amount of fluid passed to the downstream separator sections and thereafter to the submersible pump.

As depicted in the illustrative embodiments of FIG. 1, the first separator section 12 has a base 18 and a head member 20, and the second separator section 14 also has a base 18 and a head member 20. Each section of the housing 16 is a hollow, elongated, cylinder. The base 18 of the lower section 12 has a plurality of circumferentially arranged inlet ports 22 that communicate production fluid received from the underground reservoir to the interior cavities of the housing 16.

Figure 2:
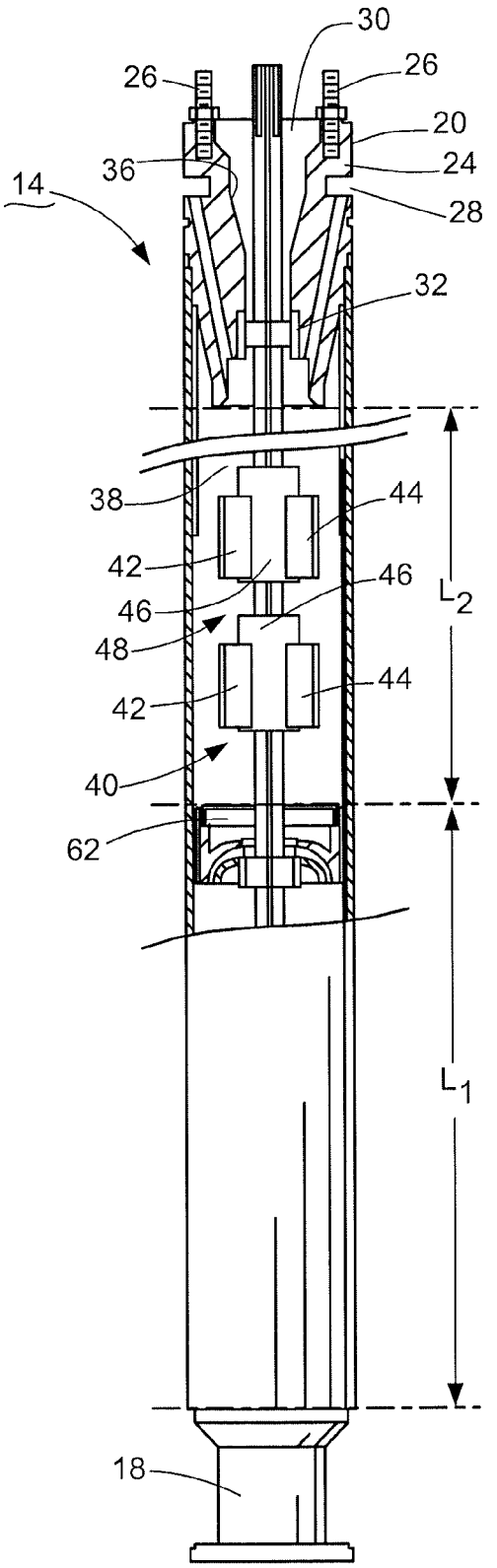
FIG. 2 is a partially detailed, side cut away, elevational view of one section of the downhole gas separator of FIG. 1.

As shown in FIG. 2, a cutaway view of the upper or second separator section 14, the head member 20 has a body portion 24 that is generally cylindrically shaped and has a plurality of upwardly extending threaded studs 26. An external, circumferential channel 28 extends around the body portion 24, and the body portion is externally threaded to engage with internal threads at the upper end of the housing 16. An upwardly opening, tapered cavity 30 extends through the body portion 24.

Figure 3:
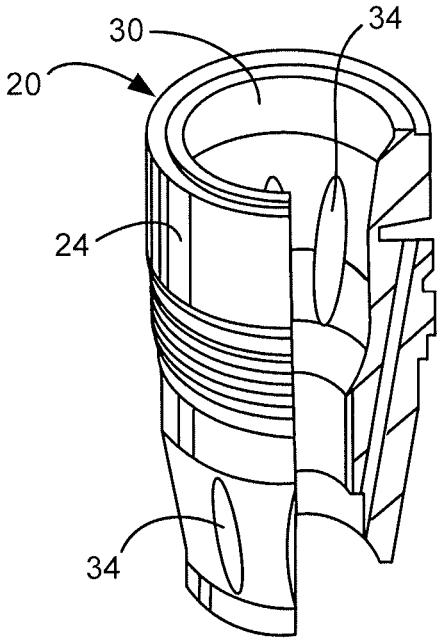
FIG. 3 is an isometric depiction of the head member.

An upper bearing (or bushing) 32 is mounted in the cavity 30. FIG. 3 depicts a plurality of circumferentially arranged liquid outlet ports 34 extend upwardly through the body portion 24 to communicate with the cavity 30. Returning to FIG. 2, a plurality of circumferentially arranged gas outlet ports 36 extend upwardly and outwardly to the channel 28 to communicate with the casing.

An elongated cylindrical drive shaft 38 with opposing splined ends extends through an interior cavity 40 of the housing 16 and is supported by appropriately spaced apart bearings to extend the length of the housing 16. As conventionally provided, a downhole electric motor (not shown in these figures) is connected to, and supported by, the base 18 on the lower end of the first separator section 12. The drive shaft 38 connects to and is rotated by the downhole electric motor, which is supplied with power by electrical conductor lines (not shown) that extend upwardly through the well bore to a power source at the ground surface. The upper end of the drive shaft 38 is connected to, and serves to power, the submersible pump.

A pair of vortex generators 42 is provided in the interior cavity 40, with each vortex generator 42 having a plurality of vertically spaced paddles 44 extending radially from a hub member 46 that is supported by the drive shaft 38. Each of the vortex generators 42 is disposed within a separation chamber portion 48. As the drive shaft 38 is rotated, typically at 3500 rpm, the paddles 44 stir the passing fluid in the separation chamber 48 into a vortex, forcing the liquid against the inner surface of the housing 16, separating the gas to pass along the axial center thereof.

Figure 4:
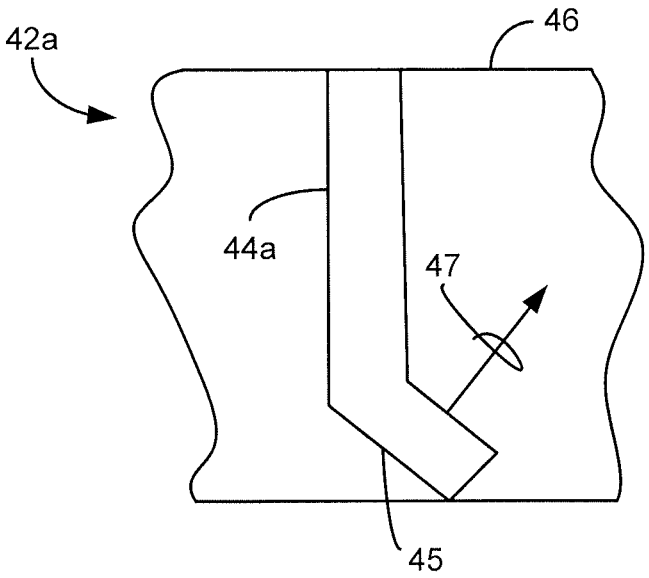
FIG. 4 is a partial elevational depiction of a vortex generator that is constructed in accordance with alternative embodiments of the present invention.

FIG. 4 depicts a partial elevational view of a vortex generator 42*a* that is constructed in accordance with alternative embodiments of the present invention. The vortex generator 42*a* has paddles 44*a* with an upper portion (as depicted) that is substantially parallel to the longitudinal axis of the housing 16 like the paddles 44 in FIG. 2. However, the lower end of one or all of the paddles 44*a* forms an angled end 45 that, as the paddles 44*a* rotate, imparts a separation force to the production fluid substantially in a direction denoted by reference arrow 47. The paddles 44 in FIG. 2 being entirely straight, result in slinging the liquid entirely radially to impinge orthogonally against the bore of the second sleeve 60. Any solid debris particulates that are entrapped in the production fluid, such as sand and the like, impinge the surface of the second sleeve 60 with maximum impact. The angled end 45 in the paddle(s) 44*a* impart a component of force to the debris particulates in the longitudinal direction causing the particulates to glance off the second sleeve 60 rather than impact it orthogonally. This lessens the erosive action of the particulates impinging against the second sleeve 60 as the result of the vortex generator 42*a* slinging the liquid outwardly during the separation of the gas from the liquid in the separation chamber 48.

Figure 5:
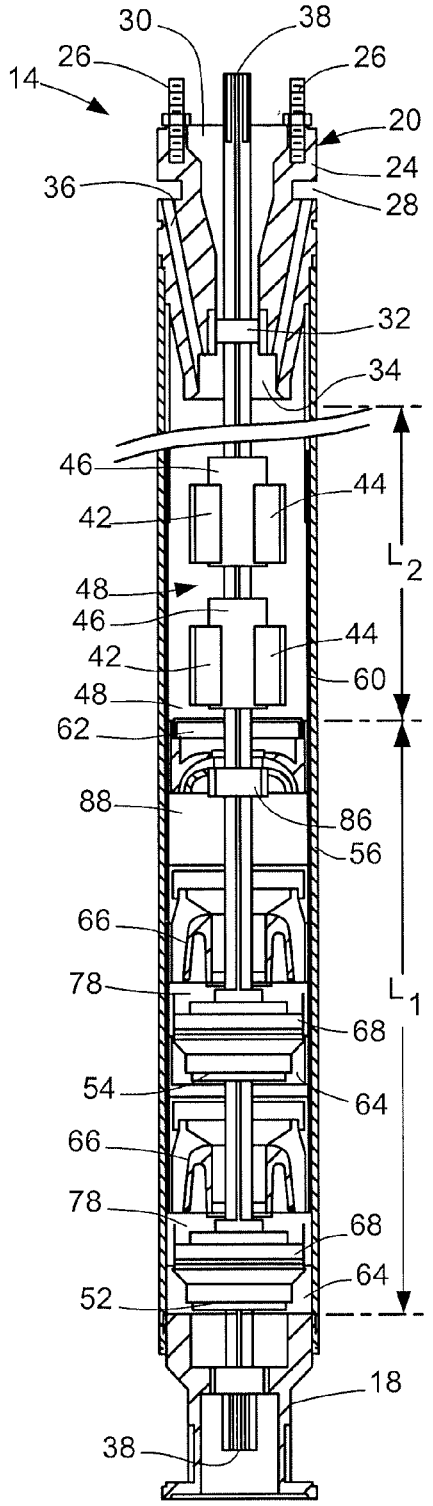
FIG. 5 is a full cutaway elevational view of a separator section of the downhole gas separator of FIG. 1.

The dimensional length of the separation chamber 48 is determined so as to provide sufficient fluid dwell time (the time for fluid to travel the length of the chamber) to effect separation of gas from the production fluid. As depicted in FIGS. 2 and 5, the length of the portion of the housing 16 below the separation chamber 48 is designated as L1 and the length of the housing 16 enclosing the separation chamber portion 48 is designated as L2. Typically, the length L2 will be about twice the length L1, or greater. While not limiting, a typical length L1 will be about 2 feet, and a typical length of L2 will be about 2½ to 5 feet. While the length of the separation chamber 48 is not critical, it is important to establish sufficient length such that gas separation occurs as the fluid passes there through. In practice, it has been found that the length of the separation chamber 48 for a downhole separator, such as the separator 10, requires approximately 1 to 10 inches per 100,000 cubic feet of gas (or 0.1 MCF), and depending on the production pressure, usually requires a minimum of about 12 inches.

Gas is separated from liquid by the downhole gas separator 10 in the separation chamber 48, and liquid is drawn from the separation chamber 48 by the submersible pump (such as 216 in FIG. 10) and to the tubing string at a rate to partially vacate the separation chamber; as used herein, the term partially vacate is meant to convey that the separation chamber 48 will have a dynamic low liquid level maintained therein during proper operation, and space is thereby provided for gas and liquid separation. As noted, the length L2 of the separation chamber 48 can vary, but this length is established as necessary to provide sufficient space and time for the gas to effectively separate from the liquid. The separated gas is passed to the casing through the gas outlet ports 36 while the remaining fluid (mostly liquid) is passed to an inlet port of the submersible pump via the liquid outlet ports 34 (FIG. 3) to be pumped through the tubing string.

As will be discussed further herein below, the downhole gas separator 10 receives gas and liquid fluid from the underground geological reservoir through the well bore, and restricts the amount of gas and liquid entering the separation chamber 48 to a flow rate less than the pumping rate of the submersible pump. A vortex of the gas and liquid is generated in the separation chamber by rotation of the vortex generator 42 so liquid is moved to the periphery of the housing 16 and the gas remains passing near the axial center thereof, the gas being separated from the liquid to pass through the gas outlet ports 36 into the well bore and the separated liquid passes out the liquid outlet ports 34 to the inlet port of the submersible pump.

Further details of the construction will now be undertaken with reference to FIG. 5. The second separator section 14 includes an internal pump 50 with first and second pumping stages 52 and 54, a first sleeve 56, a means for restricting flow 62, and a second sleeve 60, with each having a cylindrical exterior sized and shaped to fit into the interior cavity 40 of the housing 16, and with each being assembled into the interior cavity 40 in the above listed order from the base 18 to the head member 20. In the illustrated embodiments the means for restricting fluid flow 62 is a back pressure device, also sometimes referred to herein as the fluid flow restrictor 62; and it will be understood that other means for restricting fluid flow are suitable for the present invention.

The first and second pumping stages 52 and 54 each include an impeller housing 64 and a back pressure diffuser 66, sized and shaped to fit into the interior cavity 40 of the housing 16, and an impeller member 68. Internally disposed cylinder spacers (not separately numbered) serve to support and separate the components disposed in the internal cavity of the housing 16.

Figure 6:
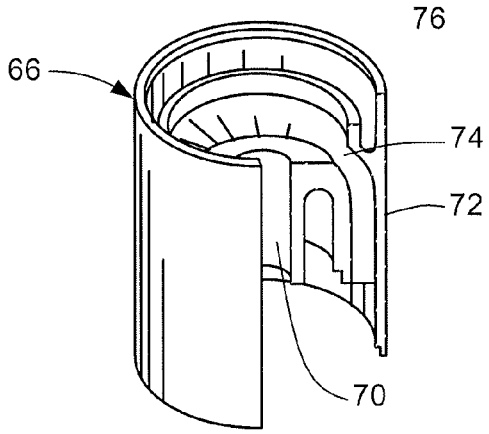
FIG. 6 is a partially cut away view of a back pressure diffuser of a pumping stage of the separator section of FIG. 3.
Figure 7:
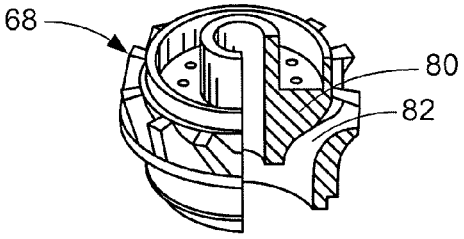
FIG. 7 is a partially cut away view of an impeller of a pumping stage of FIG. 3.

As shown in FIG. 6, the back pressure diffuser 66 includes a bore 70 extending upwardly through the center of back pressure diffuser 66, a cylindrical outer wall 72, and a plurality of spaced, radially arranged, upwardly, inwardly and helically extending passages 74 between the bore 70 and the outer wall 72, with the passages 74 being separated by radial fins 76. Referring again to FIG. 5, the impeller housing 64 and back pressure diffuser 66 define an impeller cavity 78. FIG. 7 shows the impeller 68 having a hub 80 and a plurality of spaced, radially arranged, upwardly, outwardly and helically extending passages 82 around the hub 80.

Figure 8:
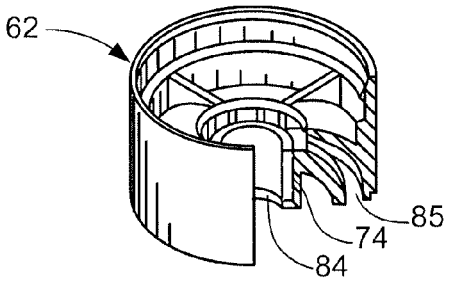
FIG. 8 is a partially cut away view of the back pressure device of the separator section of FIG. 3.

The back pressure device 62, as shown in FIG. 8, is generally cylindrical with an intermediate bearing aperture 84 and a plurality of spaced, radially arranged passages 85 extending through the back pressure device 62. An intermediate bearing 86 is mounted in the intermediate bearing aperture 84. Passages 85 are configured to restrict fluid flow so that back pressure device 62 divides the interior cavity 40 into an upstream, first chamber 88 and the separation chamber 48. In the illustrated embodiments the passages 85 extend upwardly, inwardly and helically, so that the passages 85 initiate vortex generation in the production fluid as the production fluid flows into the separation chamber 48.

The elongated drive shaft 38 extends through the interior cavity 40 of both the first and second separator sections 12 and 14 for rotation by an electrical pump (FIG. 10) supported by the base 18 of the lower or first separator section 12. Bearing journals are spaced along both first and second separator sections 12, 14 to support the shaft 38 for rotary motion; and the impellers 68 are mounted on the shaft 38 and keyed for rotation therewith. The vortex generator 42 is depicted as a paddle assembly positioned in the separation chamber 48 with the hub member 46 supported by the drive shaft 38 and having the plurality of paddles 44 extending radially from the hub member 46. Other styles of vortex generator, such as spiral or propeller, are also suitable. The separation chamber 48 is elongated, having sufficient length to allow sufficient time for gas to separate from the liquid in the production fluid. In practice, the length of the separator chamber can be up to three feet or longer.

By way of example, and not as a limitation, the back pressure device 62 can be a bearing housing of the type normally used to stabilize a long shaft in a well pump. Such bearing housings are available in different capacities to compliment the capacity of the well pump. The back pressure device 62 has a selected capacity that is selected such that the flow rate of liquid passing to the inlet port of the submersible pump is less than the capacity of the submersible pump. That is, the object is to operate the submersible pump, coupled to the downhole separator 10, somewhat lean or starved, that is, running lean of its full fluid pumping capacity at the operating rotation as powered by the drive shaft 38. Thus, the selected capacity of the back pressure device 62 limits fluid flow. Referring back to FIG. 5, each of the first and second sleeves 56 and 60 is a relatively thin walled hollow cylinder. The first sleeve 56 spaces the back pressure device 62 from the pump 50. The second sleeve 60 spaces the back pressure device 62 from the head member 20.

In accordance with preferred embodiments, the gas and liquid received by the downhole gas separator is passed through a flow restrictor with calibrated holes or bores the size of which permit passage of production fluids at a predetermined flow rate. And as discussed, the predetermined flow rate serves to determine the rate of separated liquid that is passed to the submersible pump. That is, the calibrated bores are sized to permit fluid flow of oil and gas, that will be of a different size in a well making 1000 BPD (barrels of liquid per day) and 80% gas than in a well making 1000 BPD and 40% gas. The calibrated bores are predetermined to permit passage of the correct amount of fluid to pump the well down with whatever percentage of gas that enters the separator to supply the correct amount of fluid flow for the well.

Figure 10:
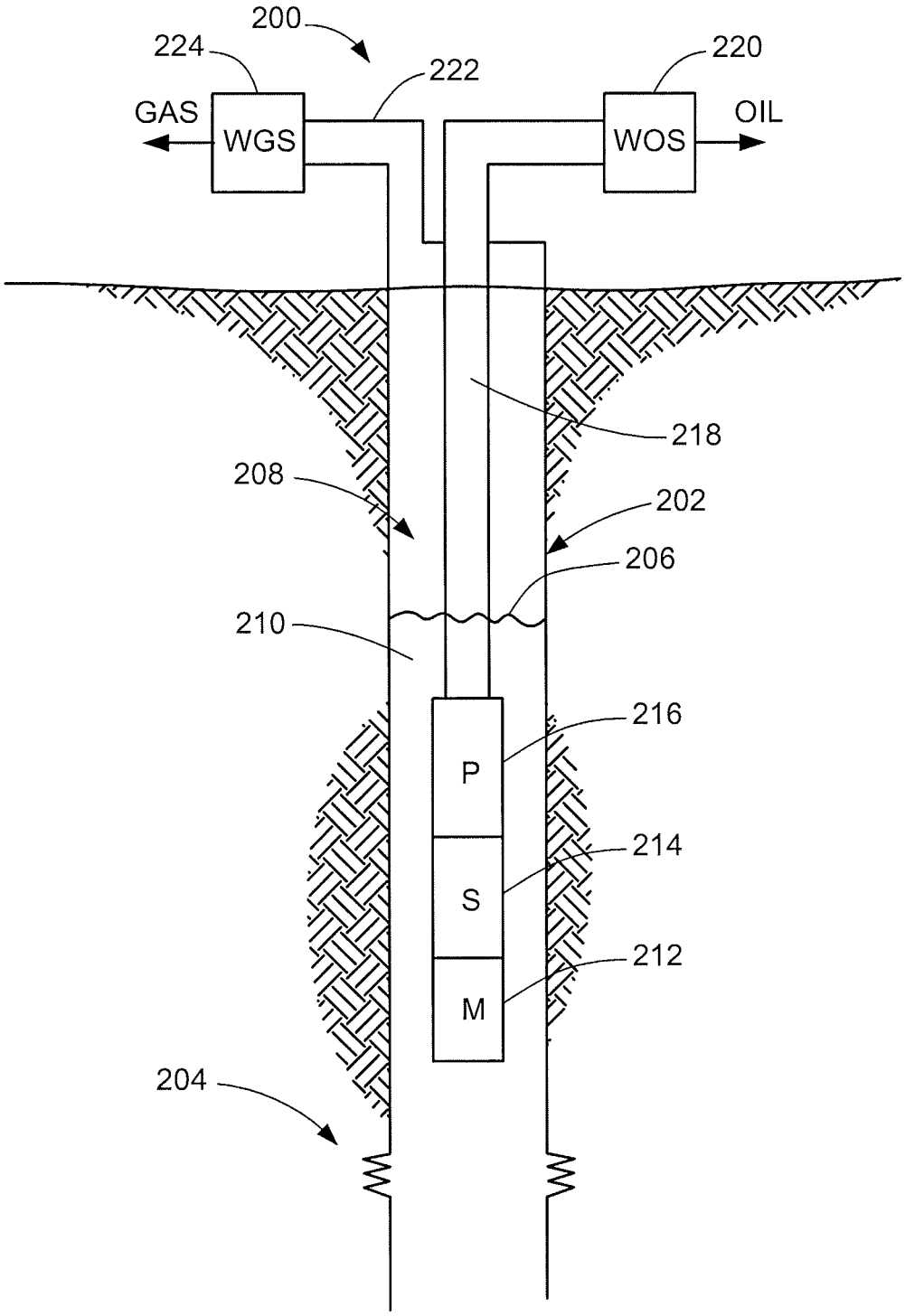
FIG. 10 is a functional block representation of a gas and liquid producing well configured and operated in accordance with various embodiments.

For alternative embodiments, each of the first and second separator sections can have a drive shaft extending therethrough to drive the components, and these individual drive shafts can be connected by means of a coupler (not shown) so an electric motor (FIG. 10) connected to the lower end of the drive shaft in the first separator section will drive both of the drive shafts. Also, the upper end of the drive shaft extending from the upper or second separator section 14 can be connected by a similar coupler (not shown) to the drive shaft of a submersible pump (FIG. 10).

As shown in FIG. 1, in the illustrative embodiments, the studs 26 on the head member 20 of the first separator section 12 connect to a flange on the base 18 of the second separator section 14 to interconnect the first and second separator sections. However, in alternative equivalent embodiments the housing 16 may unitarily form both separator sections 12, 14. As mentioned above, a typical installation of the separator 10 mounts between a motor (such as 212) on the base 18 of the first separator section 12 and a well pump (such as 216) secured to the head member 20 of the second separator section 14. The impeller 68 of the second pumping stage 54 of the second separator section 14 receives the pressurized production fluid from the first pumping stage 52 and further increases the pressure of the production fluid. The back pressure diffuser 66 of the second pumping stage 54 of the second separator section 14 builds further fluid pressure, forcing the production fluid into the first chamber 88 of the second separator section 14.

In other words, the first impeller 68 starts fluid going up and the size of the bores in the back pressure diffusers 66 is what determines the fluid flow produced and pressure required to produce the desired flow rate through the calibrated bores. The back pressure diffuser 66 also maintains the pressure until the next impeller 68 can pick up the fluid flow and maintain the flow while increasing the pressure on the fluid.

This above described process is also what occurs in the lower or first separator section 12 with this exception; as the gas is separated from the production fluid in the lower or first separator section 12, the separated portion of gas is exhausted from the gas outlet port 36 of the head member 20 into the well bore casing external to the tubing string, while the remaining portion of the fluid exiting the separation chamber 48 of the lower or first separator section 12 passes through the upper cavity 30 of the head member 20 to the lower end of the connected upper or second separator section 14.

The process is substantially repeated in the second separator section 14. The impellers 68 of the first and second pumping stages 52, 54 of the second separator section 14 pulls the remainder production fluid (the amount of production fluid to the first separator section 12 and lessened by separation and exhaustion of gas from the first separator section 12) and increases the velocity of the fluid. The back pressure diffuser 66 of the first and second pumping stages 52, 54 of the second separator section 14 pressurizes the remainder production fluid, forcing the remainder production fluid into the first chamber 88 of the second separator section 12. As gas is separated from the remainder production fluid in the upper or second separator section 14, the gas is exhausted from the gas outlet port 36 of the head member 20 into the well bore casing external to the tubing string. The liquid of the remainder production fluid is passed from the separation chamber 48 of the second separator section 14 through the upper cavity 30 of the head member 20 to the inlet port of the submersible pump.

Returning to FIG. 8, which shows the back pressure device 62, the passages 85 limit the flow of production fluid through the back pressure device 62 between the first chamber 88 and the separation chamber 48. From the back pressure device 62 the liquid and gas travel upward to the separation chamber 48 and contact with the vortex generator 42. As the drive shaft is rotated by an electric motor, typically at about 3500 rpm (but the rpm can be more or less as required for a particular installation), the paddles 44 whirl the liquid and gas in a circular vortex, thereby centrifugally separating the liquid at radially outward and the gas nearest to the axial center of the separation chamber 48. The liquid passes upwardly to the liquid outlet ports 34. Gas passes upwardly to the gas outlet ports 36 and out the downhole separator 10 into the well annulus external to the tubing string. The second separator section 14 separates gas remaining in the production fluid by the same process, and the production fluid flows from the second separator section 14 into the well pump.

The capacity of the separator 10 is selected based on the required pumping rate and the gas content of the production fluid. The capacity of the separator 10 is determined by the capacity of the first and second separation stages 12 and 14. The capacity of each of the first and second separation stages 12 and 14 is determined by the size and number of pumping stages and the restriction of the back pressure device.

Although two pumping stages are shown for each of the first and second separation stages 12 and 14, additional pumping stages can be added as may be required to increase pressure on the production fluid as required to effect proper separation. That is, the number of stages is determined as that which is necessary to effect the necessary pressure increase of the passing production fluid. For example, the pressure increase might be 13 psig for one stage and an accumulative 65 psig for five stages.

It will be appreciated that the capacity of each of the first and second separation stages 12 and 14 may be predetermined selected separately, as a portion of the gas in the production fluid is removed and exhausted to the well annulus, the liquid passing to the second separator section 14 will be the same as that entering the first separator section 12; of course, the total amount of production fluid entering the second separator section 14 will be less by the amount of gas separated and removed from the first separator section 12. The capacity of each of the separator sections will generally be determined by selecting an appropriately sized fluid restrictor, or back pressure device 62. The number and capacity of the pumping stages in each separator section is selected to build up pressure upstream of its separation chamber 48.

The capacity of the back pressure device 62 in each separator section is selected to limit the fluid flow to the respective separation chamber 48 to assure that the separation chamber 48 will not fill as fluid is withdrawn. The fluid flow out of each separation chamber 48 is the gas exiting through the gas outlet ports and the liquid pulled through the liquid outlet ports by the next downstream pump, whether that pump is in the next separator section or that pump is the submersible well pump.

As a working, typical field example, a well might be required to pump 1500 BPD (barrels per day) where the production fluid is a mixture of oil and gas, so the submersible pump would be designed by the oil well operator to have a capacity of 1600 BPD so that the pump will maintain sufficient dynamic vacation of the separation chamber of the upper separator section. For this example case, the first and second separator sections 12 and 14 can each include five pumping stages with a capacity of 6000 BPD each, the back pressure device 62 for the first separator section 12 could have a capacity of 3000 BPD and the back pressure device 62 for the second separator section 14 could have a capacity of 1500 BPD.

A method of separating gas and liquid from production fluid in a well, embodying features of the present embodiments, includes providing connected first and second separator sections each having a first chamber and a separation chamber, pumping production fluid into the first chamber of the first separator section, limiting flow of production fluid into the separation chamber of the first separator section, increasing the pressure of the production fluid as the fluid passes between the first and second chamber of the first separator section, generating a vortex in the separation chamber of the first separator section, pumping production fluid from the separation chamber of the first separator section into the first chamber of the second separator section, limiting flow of production fluid into the separation chamber of the second separator section, and generating a vortex in the separation chamber of the second separator section.

The gas is passed from each separation chamber through gas outlet ports to the well bore annulus external to the tubing string. The liquid passes from the separation chamber through liquid outlet ports to the second separator section. The steps of the first separator section are repeated in the second separator section wherein the liquid separated in the separation chamber passes to the inlet port of a submersible pump. The fluid flow capacity of the last separator section is coordinated with the capacity of the submersible pump to be less than the capacity of the submersible pump so that the last separation chamber is dynamically vacated by the submersible pump to provide sufficient space for the separation of gas and liquid.

Figure 9:
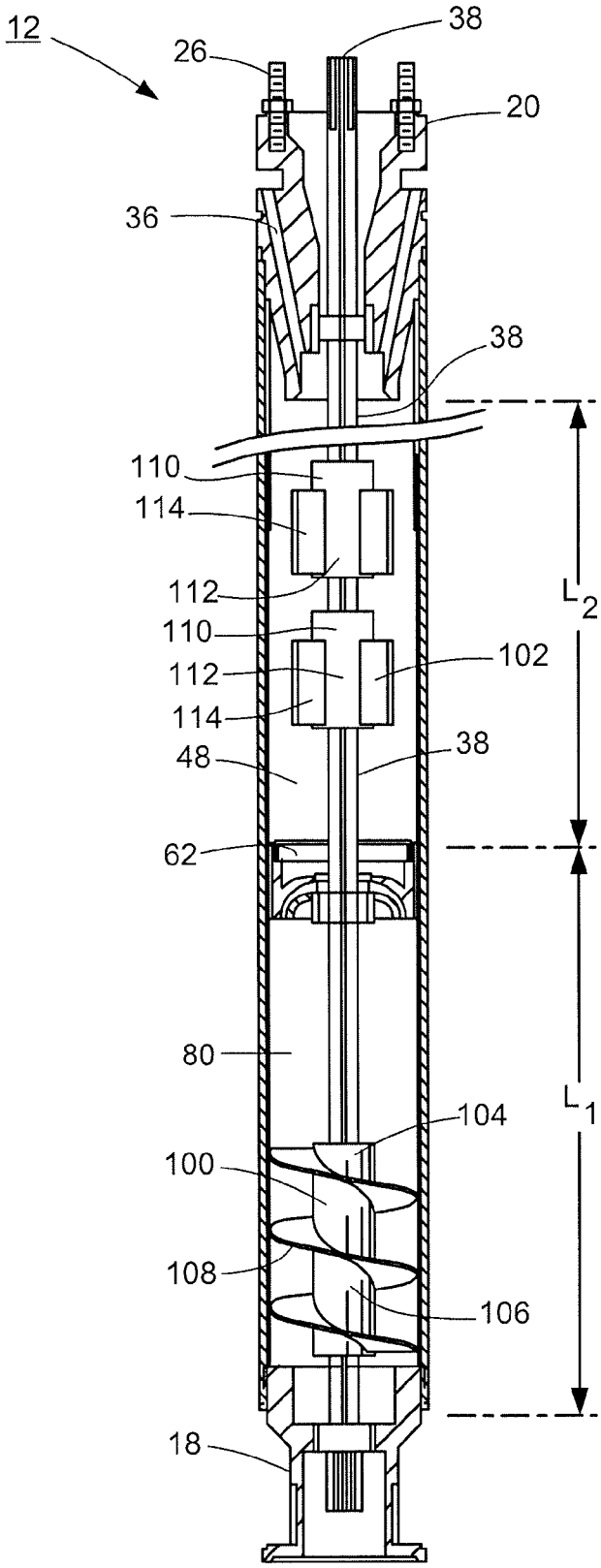
FIG. 9 is a side cut away view of a separator section of the separator of FIG. 1 with an alternative internal pump and vortex generator.

Turing now to FIG. 9, shown therein is the first or lower separator section 12 with alternative construction features capable of practicing the present inventive method. FIG. 7 shows the first separator section 12 with an alternative internal pump 100 and an alternative vortex generator 102. The internal pump 100 is an inducer 104 having an elongated, cylindrical hub member 106 and a blade 108 that projects radially from hub member 106 in an augur shape. The hub member 106 is keyed and mounted on drive shaft 38, so that the inducer 104 rotates with shaft 38. The length of inducer 104, the number of blades 108 and the angle of the blades 108 can vary. The vortex generator 102 includes a pair of spaced paddle assemblies 110, each having a hub member 112 mounted on drive shaft 38, and a plurality of spaced vertical paddles 114 that extend radially from the hub member 112. The second or upper separator section 14 is preferably constructed similarly to that here described for the first separator section 12 with the exception of the inlet ports 22 for entry of the production fluid to the first separator section 12 and different lengths of the separations chambers 48 for the different gas extraction rates, as discussed above.

The inducer 104 in first separator section 12 pumps production fluid through the first chamber 88 to the back pressure device 62, restricting the fluid flow to the separation chamber 48. The paddles 114 stir the liquid and gas into a circular vortex, thereby centrifugally separating the liquid to the radial outside and the gas to the axial center of the separation chamber 48. The remainder production fluid passes upwardly to the liquid outlet ports 34 and to the second separator section 14. Gas passes upwardly to the gas outlet ports 36 to the well annulus external to the tubing string. The second separator section 14 separates the gas of the remainder production fluid by the same process, and the liquid of the remainder production fluid flows from the second separator section 14 to the submersible pump.

It will be appreciated that the various system parameters of the disclosed system will vary greatly depending on the requirements of a given well. If the parameters are not correctly set, then the efficacy, and indeed the operational benefit of the separator, can be diminished or eliminated entirely. Moreover, the production rates of the well in terms of the amounts of oil and gas extracted from the well may be significantly reduced over what can be achieved using the presently preferred embodiments.

As noted above, previously attempted solutions seek to employ a liquid-gas separator to prevent gas lock, or cavitation, of the submersible pump, which can lead to its damage or stalling, so that ultimately the need to remove and reinsert the submersible pump to restart the process. The previously attempted solutions seek to maintain sufficient volume and pressure of the inlet liquid to the pump so that, to the extent that any gas is present in the liquid as the liquid passes into the submersible pump, the gas remains under compression as relatively small bubbles that do not interfere with the ability of the submersible pump to force the liquid component of the subterranean fluid to the surface. Previous systems thus accept the fact that the pumped fluid will maintain a substantial amount of compressed gas therein.

FIG. 8 is a functional block representation of an exemplary well system 200 configured and operated in accordance with various embodiments. The system 200 includes a well bore 202 that extends downwardly to a subterranean formation 204 having a mixture of liquid and gas. The liquid may comprise an admixture of water (fresh or brine) and oil or other liquid hydrocarbons, and the gas may comprise methane or other pressurized gases. The purpose of the well system 200 is to ultimately extract commercially useful components from the subterranean formation, such as natural gas and oil.

The well bore 202 will be of the depth suitable to reach the subterranean formation 204; such can be several hundreds or thousands of feet, and may be encased in a cylindrical casing (not separately illustrated). A liquid level within the bore is generally represented at 206, with area 208 representing a pressurized vapor space above this level. A tubing or pump string 210 extends down the center of the well bore into and below the liquid level 206 useful in urging the upward production of the desired subterranean components. The exemplary pump string 210 includes the aforementioned motor (M), liquid-gas separator (S), and submersible pump (P), respectively numerically denoted as 212, 214 and 216.

The pump string 210 further includes a liquid conduit or tubing 218 along which the pumped liquid passes upwardly through the vapor space 208 to a water-oil separator (WOS) 220, which extracts the water to produce a flow of oil for a downstream piping or storage network. A well cap mechanism 222 retains the pressure on the pressurized vapor space 208 and directs the gaseous components to a water-gas separator (WGS) to similarly direct a flow stream of pressurized natural gas for downstream processing. It will be appreciated that the diagram of FIG. 10 is greatly simplified and any number of additional components such as chokes, valves, instrumentation, conduits, conductors, and other elements may be incorporated in the system 200.

To configure the system 200, the following steps may be carried out in accordance with various embodiments. First, the desired liquid production rate of the well is identified in terms of the amount of liquid to be pumped from the well. This may be expressed in any convenient form, such as the conventionally well utilized production rate of barrels per day (BPD), with each barrel constituting a volume of liquid equal to 42 gallons and a day constituting 24 hours. For purposes of the present example, a liquid production rate value of 4,000 BPD will be selected.

At this point it will be recognized that a number such as 4,000 BPD does not usually mean that 4,000 barrels of oil will be produced each day. Rather, the amount of oil will tend to be significantly less than this amount, because in most exemplary environments the liquid will largely be water (or other non-oil liquids) and a lesser component of the extracted liquid will be oil. The amount of oil within the liquid as a percentage can be from as low of around 1% to upwards of 10% or more. Oil and water do not mix, and oil generally tends to have a lower specific gravity than water. A measure of the specific gravity of the subterranean fluid can give some indication of this ratio. It is known that salt water has a specific gravity (Sg) of around 1.05, so a Sg near this value will generally tend to indicate a relatively low oil content. A lower Sg, such as a value of around 0.8, can indicate a relatively larger oil content. Such values can be obtained from conventional instrumentation methods and are employed as set forth below.

Another initial value that may be obtained during the configuration of the system 200 is the ratio of gas to liquid to be produced by the well. It is known in the art that these ratios can vary widely from formation to formation, and can vary widely over the production age of a formation. It will be appreciated that the liquid-gas separator system disclosed herein is effectual for environments where there is a substantial amount of gas within the well bore; clearly, if the well is substantially depleted of gaseous pressure, a pump jack or other mechanical lifting means may be required to lift the liquid to the surface and there is no need for liquid-gas separation.

The amount of gas to be produced can be estimated using various well known means and instrumentation, and is usually expressed in terms of thousands of cubic feet (MCF). This can be conveniently converted to equivalent BPD volumetric rate using known conversion factors. For a present example, it will be conveniently estimated that the well system 200 of FIG. 10 will produce the equivalent of 2000 BPD of natural gas. Thus, the entire fluidic production rate (on average) will be about 6,000 BPD, of which 4,000 (or roughly 67%) will be liquid. Assuming 10% oil, the well will thus produce about 400 barrels of crude oil per day.

The sequence in designing the system 200 generally involves steps of (1) sizing the submersible pump 216 to accommodate the desired liquid extraction rate of 4,000 BPD; and (2) sizing the liquid-gas separator 218 to accommodate the gas flow rate of 2,000 BPD while ensuring the pump is enabled to meet the desired flow rate of 4,000 BPD.

To do this, the next piece of information that may be required is the depth of the liquid level line 206 relative to the surface. As before, this can be determined using suitable instrumentation. For purposes of the present example, a depth of about 2,000 feet will be used. This means that the submersible pump 216 will need to be sized to pump the liquid a vertical height of about 2,000 feet.

Figure 11:
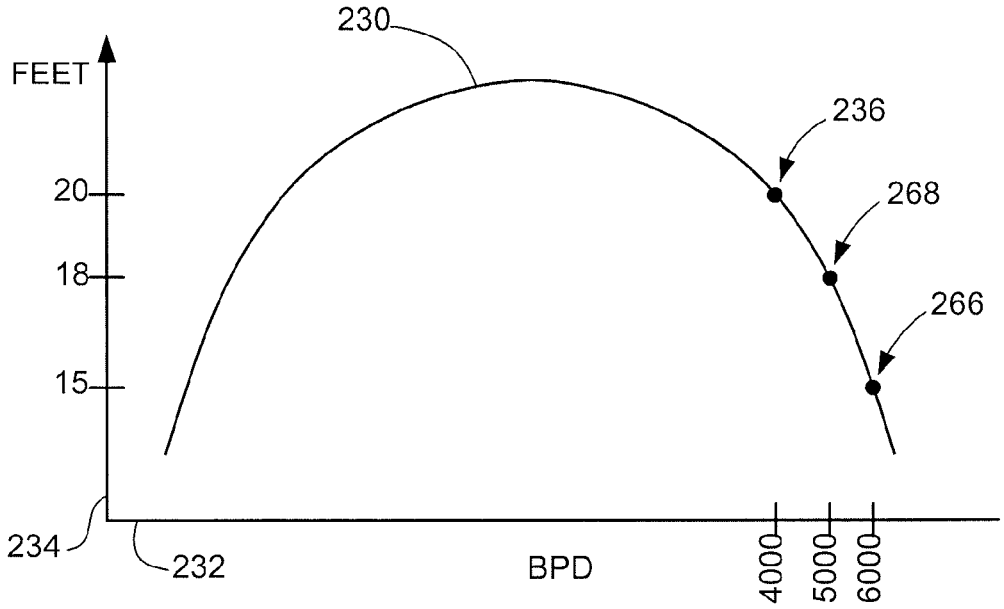
FIG. 11 shows a graphical representation of an exemplary pump curve that can be used to configure the well of FIG. 8.

FIG. 11 shows an exemplary pump curve 230 for a pumping stage such as described previously herein. Since different pump styles and pump manufacturers will have different pump curve characteristics, curve 230 is exemplary and not limiting. It is contemplated that the curve 230 describes the characteristics for a stage having two floating impellers that rotate responsive to a keyed shaft passing there through. The curve 230 is plotted against an x-axis 232 in terms of BPD and a y-axis 234 in terms of vertical height.

Point 236 on the curve shows that for a desired flow rate of 4000 BPD of liquid (at a specified Sg such as 1.05), each stage can pump this liquid a total of 20 feet. It follows that the pump or tubing string 218 may be configured of 100 such stages (100 stages×20 feet/stage=2,000 feet). This represents the general size and capacity of the pump; additional stages may be added or removed depending on empirical factors or a priori knowledge.

Figure 12:
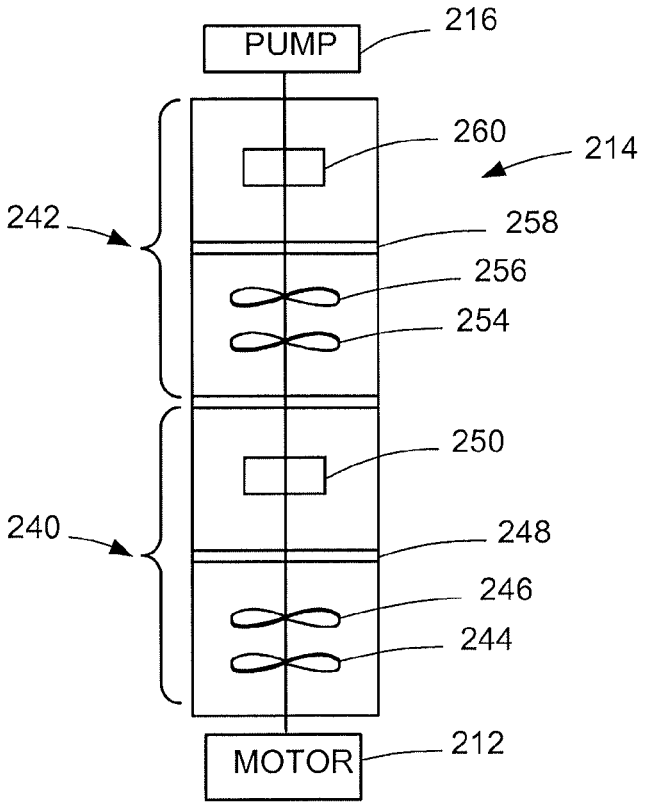
FIG. 12 is a schematic representation of a two-stage separator of the equipment configuration depicted in FIG. 8.
Figure 13:
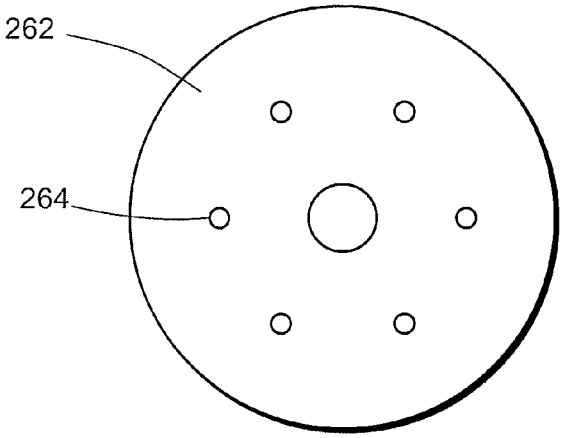
FIG. 13 is a plan view of a back pressure device in the form of a plate having a plurality of calibrated fluid passing bores.

Next, a schematic representation of the two-stage separator 214 is shown in FIG. 12, with upper and lower sections 240, 242. The liquid-gas separator 214 is sized for this pump configuration. This is carried out as discussed above to facilitate sufficient flow into the pump so that the submersible pump continuously empties the amount of liquid that is presented thereto from the uppermost separation chamber. It will be recalled that in presently preferred embodiments the separator includes two stages, a lower stage and an upper stage. The lower section 240 includes impellers 244, 246, back pressure plate 248 and impeller or vortex generator 250. The upper section 242 includes impellers 254, 256, back pressure plate 258 and impeller or vortex generator 260. The back pressure plates 248, 258 may take the form of a back pressure diffuser or a bearing housing support as discussed above, or a plate 262 with apertures or bores 264 extending there through as shown in FIG. 13.

The lower or first back pressure plate 248 should be sized to accommodate the entire inlet flow of fluid expected to pass there through, namely 6,000 equivalent BPD. While not required, it will be contemplated that the impellers 244, 246 and 254, 256 will form pumping stages that are nominally identical to the pumping stages used to form the pump 214. Hence, with reference again to the pump curve 230 in FIG. 11, it will be determined that the pumping of 6,000 BPD provides an equivalent vertical height of about 15 feet, as indicated by point 266. This vertical height can be converted to an equivalent pressure value by dividing the pressure by a well known conversion factor of 2.31. In other words, the lower stage 240 of the separator 214 will generate about 15/2.31=6.5 psig of pressure pumping the equivalent of 6,000 BPD against the first, lower back pressure plate 248.

The plate 248 is accordingly sized to accommodate the flow of 6,000 BPD at this pressure. The plate may be provisioned with a plurality of annular apertures having a combined cross-sectional area sufficient to allow this much volume to pass there through. The total cross-sectional area may be empirically determined; it has been found, for example, that a cross sectional area of 5 square millimeters ($mm^2$) will permit passage of about 500 BPD under certain operational conditions. Thus, a suitable combined equivalent area to allow 6,000 BPD to pass through the lower plate 248 may be about 60 $mm^2$. This is merely exemplary, however; empirical analysis may be required to arrive at the particular value for a particular application.

Having sized the lower plate 248, the next determination to be made is an evaluation of what percentage of gas will be removed by the lower stage 240. Again, this may require some empirical analysis. Generally, it has been found that the amount of gas in the liquid that passes from the lower stage 240 to the upper stage 242 will depend on a variety of factors including the specific gravity of the fluid. For a higher Sg, less gas may be removed whereas for a lower Sg, more gas may be removed. An exemplary value may be 50% of the gas in the fluid passing into the lower stage 240 is removed by the lower stage. Using this value, it can be seen that there will now only be the equivalent of 1000 BPD (2,000 BPD×0.50) of gas passing into the upper stage 242. This means that, generally, the upper stage 242 will be receiving the equivalent of about 5,000 BPD of fluid.

Returning again to the curve 230 of FIG. 11, a BPD rate of 5,000 BPD will provide a vertical height value of about 18 feet, as indicated by point 268 on the curve. This converts to a back pressure of about 7.8 psig. The upper back plate 258 is sized to permit the flow of the equivalent of about 5,000 BPD there through at this pressure. Empirical analysis will allow determination of this value. An exemplary value may be on the order of about 50 $mm^2$ of total surface area of the apertures passing through the upper plate 242.

In some embodiments, the upper plate can be sized as a derated value of the lower plate, rather than by making reference to the pump curve. The upper plate will generally tend to have a smaller cross-sectional area because of the removal of gas from the inlet fluid. Accordingly, the upper plate is sized to ensure that the upper chamber is supplied with just this amount so that the submersible pump empties the separation chamber and runs lean. This promotes the efficacy of the separator so that substantially no component of gas remains in the liquid stream passing through the pump.

Once installed, in some embodiments the system can be adaptively adjusted to attain an optimum level of performance through the adjustment of various parameters. This allows the system to be tuned to ensure that the upper chamber of the liquid-gas separator is being fully vacated by the pump operation; that is, the pump is operated to empty the upper chamber at the same rate at which the liquid is being introduced into the upper chamber.

Some systems utilize a variable frequency drive mechanism at the surface of the well that allows adjustments in the rotational rate of the motor that drives the central shaft to which the submersible pump, impellers and inducers are coupled. While the system may be designed to operate at a selected alternating current (AC) frequency, such as 60 Hz, an operative range may be available so that the motor can be rotated at any desired frequency from a lower rate of from around 50 Hz or less to an upper rate of around 70 Hz or more.

In such case, the system can be initially operated at a baseline frequency, such as 60 Hz. The pump efficiency can be evaluated at this level through various measurements such as the volume of liquid passing to the surface, the pressure of this liquid, a pressure measurement within the upper chamber, and so on. If less than optimum pump efficiency is observed, a user can slowly increase the frequency of the motor operation, such as from 60 Hz to 65 Hz. This may result in an increase in the volume of liquid reaching the surface since the pump will generally be able to pump more liquid at a higher rotational rate, whereas the maximum amount of liquid that can flow into the upper chamber remains fixed due to the orifice size of the back pressure plate.

As the user continues to increase the frequency, there may be a point at which higher frequencies do not provide further increases in the amount of liquid being pumped to the surface; that is, the volume of liquid becomes substantially constant, but the pressure of the fluid increases. The user may thus reduce the frequency of the motor back down to the point at which the maximum liquid volume, and the lowest liquid pressure, are obtained. Similar adjustments may be made to reduce the frequency from a first baseline frequency, such as 60 Hz, to a lower optimum frequency, such as 55 Hz. Such adjustments may further be made from time to time (e.g., on a monthly basis, etc.) as formation conditions change to maintain the system operation at optimum levels.

Figure 14:
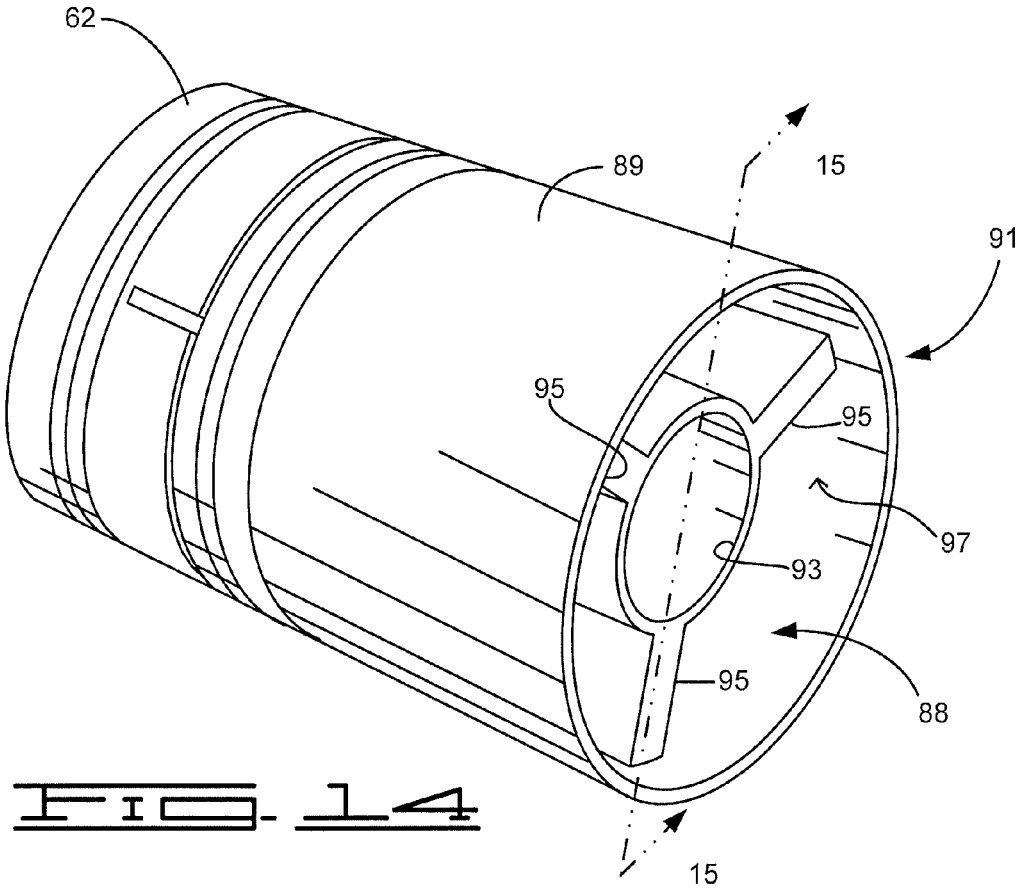
FIG. 14 is an isometric depiction of the back pressure device and cylinder defining the first chamber upstream of the separation chamber.

FIG. 14 is an isometric depiction of the back pressure device 62 (sometimes referred to as fluid flow restrictor or means for restricting fluid flow) having a longitudinally extending cylinder 89 defining the first chamber 88. The cylinder 89 spaces the back pressure device 62 longitudinally from the output of the second stage pump 54, and the first chamber 88 queues the pressurized production fluid before entry into the inlets 85 (FIG. 8) of the back pressure device 62 at the desired rate in accordance with the embodiments of the present invention.

An additional support 91 for the rotating shaft 38 (the shaft 38 is not depicted in FIG. 14) may be provided within the first chamber 88 to further stabilize the shaft 38 and thereby minimize the runnout of the shaft 38 as it rotates within the bearing 86 supported in the back pressure device 62. The support 91 generally has a central block defining a bore 93 that is sized to operably support a bearing (not depicted, such as a bushing) sized for operation with the diameter of the shaft 38. In the depicted embodiments the central block defines a circular outer surface 87, although the contemplated embodiments are not so limited as further discussed below.

A number (in these embodiments three) of radially-directed stanchions 95 extend between the circular support member 91 and the bore 97 of the cylinder 89. The stanchions 95 are adequately sized and preferably distributed uniformly (in these embodiments 120 degrees apart) to adequately support and stabilize the bore 93 and thereby to damp any shaft 38 runnout during the shaft 38 rotation in the harsh conditions associated with the production fluid being pumped by the shaft 38.

Figure 15:
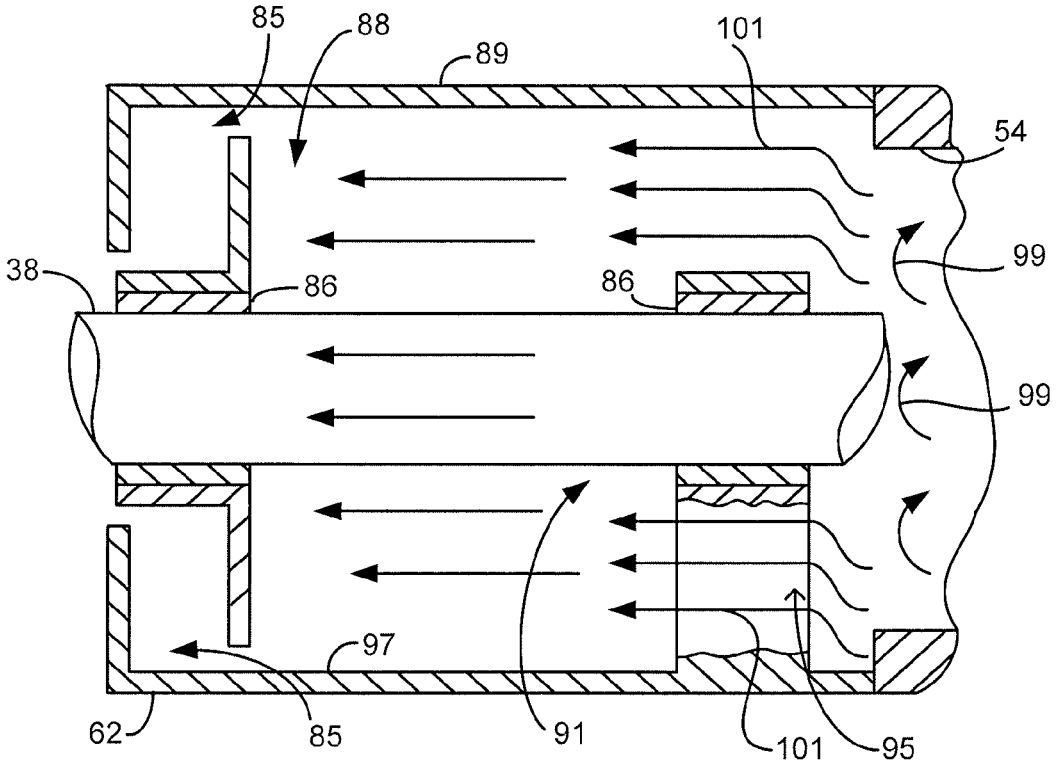
FIG. 15 is a partially cut away view of the back pressure device and cylinder of FIG. 14.

FIG. 15 is a partial cross-sectional view along the line 15-15 in FIG. 14 and further depicting the manner in which the shaft 38 is operably supported for rotation by the bearing 86 in the back pressure plate 62 as discussed above, and likewise supports by another bearing 86 in the support member 91. The helically-shaped passages 85 (FIG. 8) are depicted for the general manner in which they begin inside the first chamber 88 nearest the bore 97 of the cylinder 89 and spiral toward the center of the back pressure plate 62 where the production fluid enters the separation chamber 48. The production fluid upstream of the support 91 is turbulent, depicted by the circular eddies 99, from the effects of the pumping action imparted by the second stage pump 54. The stanchions 95 are preferably constructed to define longitudinally-extending planar surfaces against which the turbulent fluid flow impinges and is thereby straightened, as depicted by the curved-to-linear flow paths 101. Note particularly that the stanchion 95 is depicted in a partially cut away manner in order to depict how the rotational production fluid flow impinges against the planar surface of the stanchion 95 and is thereby straightened along the longitudinal axis of the separator section 12, 14. Note particularly that the straightened That straightened fluid flow reduces the kinetic mixing of the gas and liquid components as the production fluid enters the back pressure plate 62, enhancing the ability to separation the gas from the liquid when the production fluid is subjected to the partial evacuation of the separation chamber 48.

Figure 16:
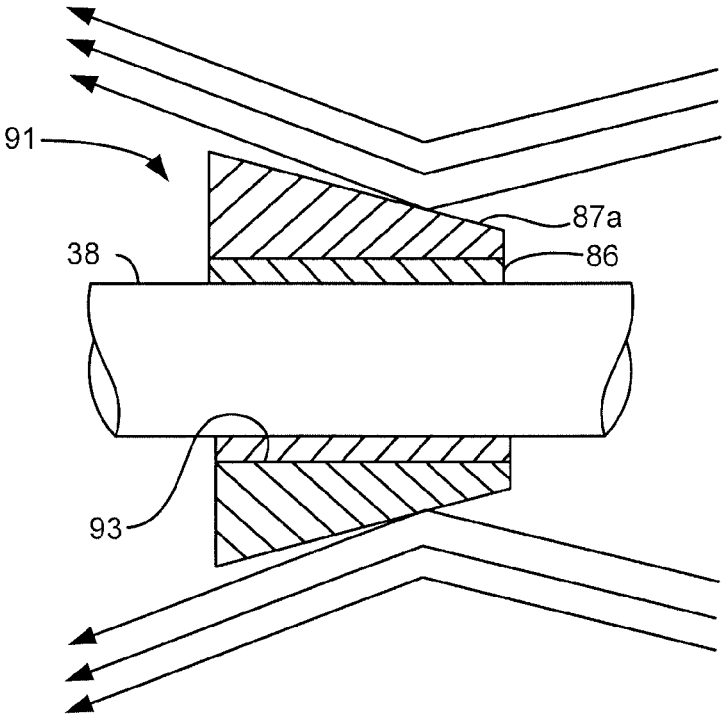
FIG. 16 is a partially cut away view similar to FIG. 15 but depicting a cylinder that is constructed in accordance with alternative embodiments of the present invention.

FIG. 16 is an enlarged cross sectional depiction of a portion of the support 91 taken along a different center line that does not intersect any of the stanchions 95. The center block defining the bore 93 is modified by angling the outer surface 87*a* so that it progressively narrows the gap through which the straightened fluid path passes. As indicated by the fluid path arrows, the angled center block surface 87*a* deflects the fluid that impinges against it, and the surface 87*a* by increasing the pressure also bends the nearby fluid paths in a direction angling toward the bore 97 of the cylinder 89. The depicted angle and shape of the surface 87*a* is merely illustrative, not limiting, of the different shapes that can be used depending on the fluid flow conditions for a particular well. Certainly any attempt to enumerate all possible shapes for the outer surface of the center block is unnecessary for the skilled artisan to ascertain the scope of the claimed subject matter. The angled outer surface 87*a* in these embodiments advantageously directs the straightened fluid path toward the inlets 85 of the back pressure plate 62 making for a more efficient transition of the fluid into the back pressure plate 62. The straightened and bent fluid paths also advantageously directs any fluid borne debris away from the downstream bearing 86, lessening the adverse affects of the debris otherwise impinging the bearing and damaging the close mating relationship between the shaft 38 and the bearing 86.

The various features and alternative details of construction of the apparatuses described herein for the practice of the present invention will readily occur to the skilled artisan in view of the foregoing discussion, and it is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A separator for separating gas from a production fluid produced from an oil well extending into a subterranean formation, the separator connectable to a pump motor for flowing the production fluid through the separator, the separator comprising:

a housing sized to be insertable into the oil well and defining an internal cavity, the housing having an inlet at one end defining a passage for entry of the production fluid into the cavity, the housing having an internal diameter of the same dimension throughout the length thereof;

a first pumping stage in the housing pressurizing the production fluid from the inlet to flow in a direction substantially parallel to the longitudinal direction of the housing;

a first fluid flow restrictor in the housing downstream of the first pumping stage, the first fluid flow restrictor defining a passage limiting the production fluid from the first pumping stage to a selected first flow rate;

a first separation chamber in the housing downstream of the first fluid flow restrictor in which some of the gas separates from the production fluid, the separated gas directed to the oil well;

a second pumping stage in the housing further pressurizing the production fluid from the first separation chamber;

a second fluid flow restrictor in the housing downstream of the second pumping stage, the second fluid flow restrictor defining a passage limiting the production fluid flow from the second pumping stage to a selected second flow rate, wherein the second flow rate is less than the first flow rate of the first fluid flow restrictor;

a second separation chamber in the housing downstream of the second fluid flow restrictor in which additional gas separates from the production fluid, the gas separated from the production fluid directed to the oil well; and a drive shaft extending the length of the housing and connected to and rotated by the pump motor;

wherein the first fluid flow restrictor comprises:

an extension cylinder having an internal chamber; and a support member disposed in the internal chamber and having a central block defining a bore through which the drive shaft extends, a plurality of stanchions extending from the central block, the stanchions having longitudinally extending planar surfaces against which the turbulent flow of the production fluid impinges and is straightened;

wherein the central block has an angled surface whereby debris of the straightened fluid flow impacts the angled surface, the impacted debris directed in an angular path away from the angled surface.

2. A separator for separating gas from a production fluid produced from an oil well extending into a subterranean formation, the separator connectable to a pump motor for flowing the production fluid through the separator, the separator comprising:

a housing sized to be insertable into the oil well and defining an internal cavity, the housing having an inlet at one end defining a passage for entry of the production fluid into the cavity, the housing having an internal diameter of the same dimension throughout the length thereof;

a first pumping stage in the housing pressurizing the production fluid from the inlet to flow in a direction substantially parallel to the longitudinal direction of the housing;

a first fluid flow restrictor in the housing downstream of the first pumping stage, the first fluid flow restrictor defining a passage limiting the production fluid from the first pumping stage to a selected first flow rate;

a first separation chamber in the housing downstream of the first fluid flow restrictor in which some of the gas separates from the production fluid, the separated gas directed to the oil well;

a second pumping stage in the housing further pressurizing the production fluid from the first separation chamber;

a second fluid flow restrictor in the housing downstream of the second pumping stage, the second fluid flow restrictor defining a passage limiting the production fluid flow from the second pumping stage to a selected second flow rate, wherein the second flow rate is less than the first flow rate of the first fluid flow restrictor; and a second separation chamber in the housing downstream of the second fluid flow restrictor in which additional gas separates from the production fluid, the gas separated from the production fluid directed to the oil well;

wherein the first fluid flow restrictor comprises:

an extension cylinder having an internal chamber;

a support member disposed in the internal chamber supporting the extension cylinder and having a central block defining a bore through which the drive shaft extends; and a plurality of stanchions extending from the central block, the stanchions defining longitudinally extending planar surfaces against which the turbulent fluid flow of the production fluid impinges and is straightened.

3. A separator for separating gas from a production fluid produced in an oil well bore extending into a subterranean formation, the separator connectable to a pump motor for flowing the production fluid through the separator, the separator comprising:

a housing having an internal cavity and having an inlet port for entry of the production fluid in to the cavity;

a rotatable drive shaft extending the length of the separator connected to the pump motor;

a first pumping stage pressurizing the production fluid;

a first fluid flow restrictor downstream of the first pumping stage, the first fluid flow restrictor limiting the production fluid from the first pumping stage to a selected first flow rate;

a first separation chamber downstream of the first fluid flow restrictor and separating some of the gas from the production fluid, the separated gas discharged to the oil well bore, the first separation chamber having a first vortex generator mounted to the drive shaft, the generator having a first plurality of paddles, each paddle having an angled distal end that upon rotation of the drive shaft impacts particulate debris so that the debris is diverted to an angular direction different to the direction imparted by the other part of the paddle;

a second pumping stage further pressurizing the production fluid from the first separation chamber;

a second fluid flow restrictor downstream of the second pumping stage limiting the production fluid flow from the second pumping stage to a selected second flow rate, the second flow rate less than the first flow rate of the production fluid; and a second separation chamber downstream of the second fluid flow restrictor and in which additional gas separates from the production fluid, the separated gas discharged to the oil well bore.

4. The separator of claim 3 wherein the second separation chamber comprises a second vortex generator mounted to the drive shaft, the generator having a second plurality of paddles, each paddle having an angled distal end that upon rotation of the drive shaft impacts particulate debris so that the debris is diverted to an angular direction different to the direction imparted by the other part of the paddle.

5. The separator of claim 3 wherein the first fluid flow restrictor comprises:

an extension cylinder having an internal chamber;

a support member disposed in the internal chamber and having a central block defining a bore through which the drive shaft extends, a plurality of stanchions extending from the central block, the stanchions having longitudinally extending planar surfaces against which the turbulent fluid flow of the production fluid impinges and is straightened.

6. The separator of claim 5 wherein the central block supports a bearing upon which the drive shaft is supported for rotation.

7. The separator of claim 6 wherein the central block has an angled surface whereby debris of the straightened fluid flow impacts the angled surface, the impacted debris directed in an angular path away from the angled surface.

* * * * *